US009238561B2

(12) United States Patent
Ichihashi

(10) Patent No.: US 9,238,561 B2
(45) Date of Patent: Jan. 19, 2016

(54) IMAGE FORMING APPARATUS

(71) Applicant: KYOCERA Document Solutions Inc., Osaka (JP)

(72) Inventor: Takao Ichihashi, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/708,092

(22) Filed: May 8, 2015

(65) Prior Publication Data

US 2015/0321878 A1 Nov. 12, 2015

(30) Foreign Application Priority Data

May 9, 2014 (JP) ..... 2014-097723

(51) Int. Cl.

| | |
|---|---|
| ***B65H 3/44*** | (2006.01) |
| ***G03G 15/00*** | (2006.01) |
| ***B41J 3/60*** | (2006.01) |
| ***B65H 85/00*** | (2006.01) |
| ***B65H 1/04*** | (2006.01) |
| ***B65H 3/06*** | (2006.01) |
| ***B65H 5/06*** | (2006.01) |
| ***B65H 7/20*** | (2006.01) |
| ***B65H 7/02*** | (2006.01) |
| ***B65H 15/00*** | (2006.01) |
| ***B65H 29/22*** | (2006.01) |
| ***B65H 29/60*** | (2006.01) |
| ***B65H 31/00*** | (2006.01) |
| ***B65H 43/00*** | (2006.01) |
| ***G03G 15/23*** | (2006.01) |

(52) U.S. Cl.

CPC ... *B65H 3/44* (2013.01); *B41J 3/60* (2013.01); *B65H 1/04* (2013.01); *B65H 3/0676* (2013.01); *B65H 3/0684* (2013.01); *B65H 5/068* (2013.01); *B65H 7/02* (2013.01); *B65H 7/20* (2013.01); *B65H 15/00* (2013.01); *B65H 29/22* (2013.01); *B65H 29/60* (2013.01); *B65H 31/00* (2013.01); *B65H 43/00* (2013.01); *B65H 85/00* (2013.01); *G03G 15/234* (2013.01); *G03G 15/5091* (2013.01); *G03G 15/6514* (2013.01)

(58) Field of Classification Search

CPC ..... B65H 3/44; B65H 3/446; B65H 85/00; G03G 15/234; G03G 15/6514; G03G 15/5091; B41J 3/60

See application file for complete search history.

(56) References Cited

FOREIGN PATENT DOCUMENTS

| | | | | |
|---|---|---|---|---|
| JP | 2004085805 | A | * | 3/2004 |
| JP | 2005-191873 | A | | 7/2005 |
| JP | 2009109763 | A | * | 5/2009 |
| JP | 2009154540 | A | * | 7/2009 |
| JP | 2009169105 | A | * | 7/2009 |

* cited by examiner

*Primary Examiner* — Luis A Gonzalez

(74) *Attorney, Agent, or Firm* — Studebaker & Brackett PC

(57) ABSTRACT

When one or more reused sheets each having a printed side and an unprinted side on which duplex printing has been performed are ejected onto an exit tray and then loaded onto a manual feed tray, an operation control section controls a sheet feed section to feed sheets alternately from a sheet feed cassette and the manual feed tray. At times at which the sheets in the sheet feed cassette are fed, the operation control section controls an image forming section to form, on the sheets fed from the sheet feed cassette, images that have been formed over the printed sides of the reused sheets in the duplex printing. At times at which the sheets loaded onto the manual feed tray are fed, the operation control section controls the image forming section to not form an image and causes the sheets to be ejected onto the exit tray.

9 Claims, 9 Drawing Sheets

IMAGE FORMING APPARATUS

INCORPORATION BY REFERENCE

The present application claims priority under 35 U.S.C. §119 to Japanese Patent Application No. 2014-097723, filed May 9, 2014. The contents of this application are incorporated herein by reference in their entirety.

BACKGROUND

The present disclosure relates to an image forming apparatus and in particular relates to a technique for reducing wasteful consumption of sheets of paper due to printing errors during duplex printing.

In order to effectively reuse resources and reduce costs, it is common practice to load sheets of paper on which simplex printing has already been performed (referred to below as reused sheets) into a specific one of a plurality of sheet feed cassettes in an image forming apparatus, and to print on unprinted sides of the reused sheets. Unfortunately, the sheet feed cassette in which the reused sheets are stored may be mistakenly selected in duplex printing for which it is necessary to use sheets of paper on which printing has not been performed on either side thereof (referred to below as new sheets). In such a situation, printing is performed on printed sides of the reused sheets, resulting in a printing error.

In a known technique, for example, each sheet feed cassette is set in advance as either storing new sheets or reused sheets in order to solve the above-described problem. When an instruction for duplex printing is received, simplex printing is performed instead of duplex printing if the instruction indicates a sheet feed cassette that is set as storing reused sheets therein. Thus, printing is prevented from being mistakenly performed on the printed sides of reused sheets.

SUMMARY

An image forming apparatus according to an aspect of the present disclosure includes a sheet feed section, a sheet conveyance section, a reception section, an image forming section, an exit tray, and an operation control section. The sheet feed section includes a sheet feed cassette and a manual feed tray, and feeds a sheet stored in the sheet feed cassette or a sheet loaded onto the manual feed tray. The sheet conveyance section includes a sheet reversing mechanism for reversing sides (front and rear sides) of the sheet and conveys the sheet fed by the sheet feed section. The reception section receives input pertaining to image formation. The image forming section forms an image on the sheet based on image data indicated by an image formation instruction received by the reception section. The sheet is ejected onto the exit tray after the image has been formed thereon by the image forming section. The operation control section controls operation of the sheet feed section, the sheet conveyance section, and the image forming section. The operation control section controls the sheet conveyance section to reverse the sheet using the sheet reversing mechanism in order to perform duplex image formation on the sheet. When duplex image formation is performed on one or more reused sheets each having a printed side and an unprinted side fed from the sheet feed cassette and the reused sheets on which the duplex image formation has been performed are loaded onto the manual feed tray, the operation control section: controls the sheet feed section to alternately feed sheets stored in the sheet feed cassette and the sheets loaded onto the manual feed tray; controls the image forming section to form, on the sheets fed from the sheet feed cassette, images that have been formed over the respective printed sides of the reused sheets in the duplex image formation at times at which the sheets stored in the sheet feed cassette are fed by the sheet feed section; controls the sheet conveyance section to eject onto the exit tray the sheets which have been fed from the sheet feed cassette and on which the images have been formed; controls the image forming section to not form an image at times at which the sheets loaded onto the manual feed tray are fed by the sheet feed section; and controls the sheet conveyance section to eject onto the exit tray the sheets that have been fed from the manual feed tray.

DETAILED DESCRIPTION

Figure 1:
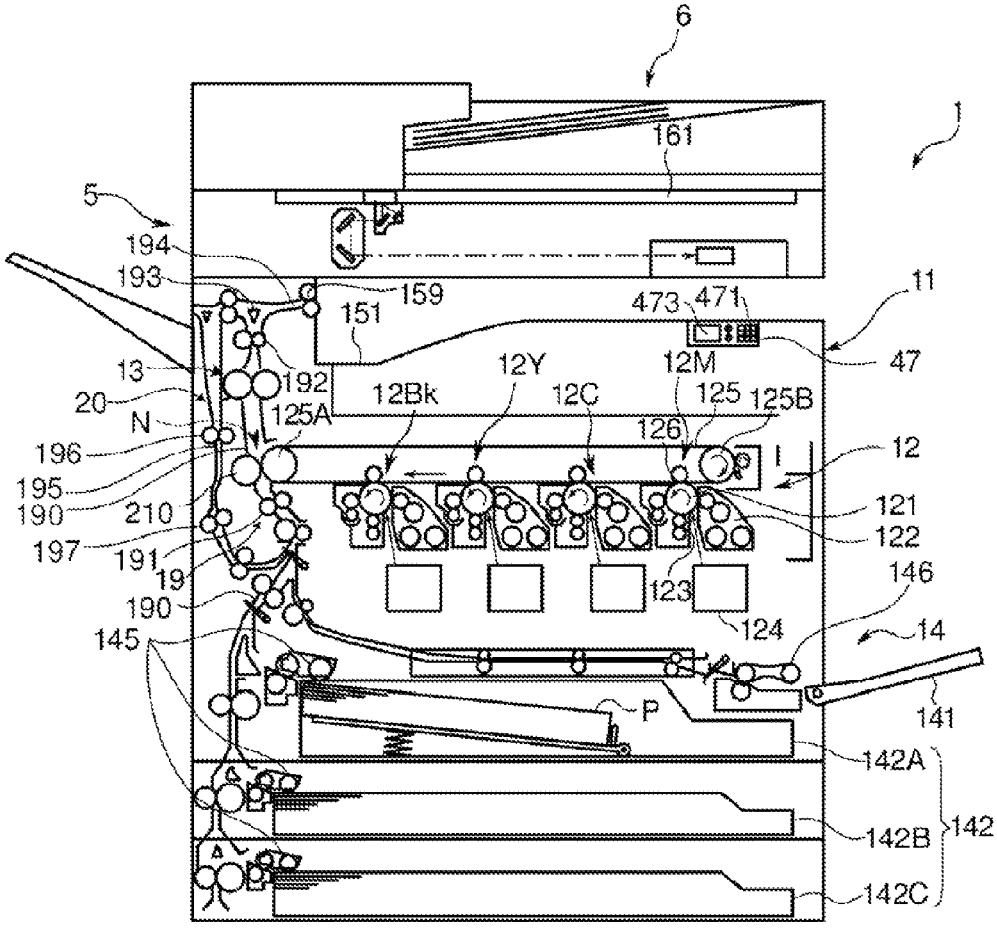
FIG. 1 is a diagram illustrating a structure of an image forming apparatus according to an embodiment of the present disclosure.

Hereinafter, an image forming apparatus according to an embodiment of the present disclosure will be described with reference to the accompanying drawings. FIG. 1 is a diagram illustrating a structure of an image forming apparatus 1 according to an embodiment of the present disclosure.

The image forming apparatus 1 according to the embodiment of the present disclosure is for example a multifunction peripheral that has a plurality of functions such as a copying function, a printing function, a scanning function, and a facsimile function. The image forming apparatus 1 includes an apparatus body 11, an image forming section 12, a fixing section 13, a sheet feed section 14, a sheet conveyance section 19, a document scanning section 5, and a document feed section 6.

The image forming apparatus 1 performs a document scanning operation as follows. The document scanning section 5 generates image data by optically scanning an image of a document that is fed by the document feed section 6 or a document that is loaded onto document loading glass 161.

The image forming apparatus 1 performs an image formation operation as follows. The image forming section 12 forms an image on a sheet P fed from the sheet feed section 14 and conveyed by the sheet conveyance section 19 based on image data generated through the document scanning operation or image data received from a network-connected computer or the like.

The sheet feed section 14 includes sheet feed cassettes 142 that are detachable from the apparatus body 11. In the example illustrated in FIG. 1, the sheet feed cassettes have three sheet feed cassettes 142A, 142B, and 142C. A sheet feed roller 145 is provided above each of the sheet feed cassettes 142A, 142B, and 142C. The sheet feed roller 145 picks up the sheet P stored in a corresponding one of the sheet feed cassettes 142A, 142B, and 142C, and feeds the sheet P toward a conveyance path 190. The sheet feed section 14 includes a manual feed tray 141 that is openable and closable relative to a wall of the apparatus body 11. The sheet P loaded onto the manual feed tray 141 is picked up and conveyed toward the conveyance path 190 by a sheet feed roller 146.

The sheet conveyance section 19 includes the conveyance path 190 and pairs of conveyance rollers 191 and 192 that are located at appropriate positions along the conveyance path 190. The sheet P fed from the sheet feed section 14 is conveyed by the pairs of conveyance rollers 191 and 192 along the conveyance path 190.

The image forming section 12 includes image forming units 12M, 12C, 12Y, and 12Bk that each include a photosensitive drum 121, a developing device 122, a toner cartridge (not shown), a charger 123, a light exposure device 124, and a primary transfer roller 126. Each developing device 122 supplies a toner to the corresponding photosensitive drum 121. Each toner cartridge contains a toner.

The image forming units 12M, 12C, 12Y, and 12Bk are the image forming unit 12M for magenta, the image forming unit 12C for cyan, the image forming unit 12Y for yellow, and the image forming unit 12Bk for black, respectively. During color printing, the image forming units 12M, 12C, 12Y, and 12Bk each form a toner image on the corresponding photosensitive drum 121 based on image data of a corresponding color component, among color components configuring image data, through charging, light exposure, and developing processes. The toner images are each transferred by the corresponding primary transfer roller 126 onto an intermediate transfer belt 125 that is stretched around a drive roller 125A and a driven roller 125B.

An outer circumferential surface of the intermediate transfer belt 125 is an image bearing surface onto which the toner images are transferred. The intermediate transfer belt 125 is driven by the drive roller 125A in a state of contact with respective circumferential surfaces of the photosensitive drums 121. The intermediate transfer belt 125 circulates continuously between the drive roller 125A and the driven roller 125B in synchronization with each of the photosensitive drums 121.

The toner images of the various colors that are transferred onto the intermediate transfer belt 125 are superimposed on one another on the intermediate transfer belt 125 such as to form a color toner image. A secondary transfer roller 210 transfers the color toner image that is formed on the surface of the intermediate transfer belt 125, onto a sheet P that is conveyed by the pair of conveyance rollers 191. The secondary transfer roller 210 transfers the color toner image onto the sheet P in a nip N where the intermediate transfer belt 125 is sandwiched between the secondary transfer roller 210 and the drive roller 125A. The fixing section 13 subsequently fixes the toner image to the sheet P through thermal fixing. After the fixing process has been completed on the sheet P, the sheet P passes along an ejection conveyance path 194 extending upward from the fixing section 13 (a section of the conveyance path 190) and is ejected onto an exit tray 151 by a pair of ejection rollers 159.

The image forming apparatus 1 has two operating modes, "normal mode" and "printing error checking mode", for a duplex printing operation in which images are formed on both sides of a sheet P. Switching between the operating modes is performed based on input from a user received by a reception section 103 (see FIG. 3) of a control unit 10 to be described later. The "normal mode" is an operating mode in which duplex printing is performed in the same manner as duplex printing in a generic image forming apparatus. In the "printing error checking mode", the following processes are performed after duplex printing is performed in the same manner as duplex printing in a generic image forming apparatus. The reception section 103 (see FIG. 3) receives input from a user indicating whether the sheets ejected onto the exit tray are new sheets that have undergone duplex printing or reused sheets that have undergone duplex printing (printing error). When the reception section 103 receives input from a user indicating that the sheets ejected onto the exit tray are those that have undergone the printing error, only image data relevant to the printing error is used to perform reprinting and the sheets P that have undergone the reprinting are ejected such that they are inserted into appropriate positions among the sheets P that have undergone the previous printing. Hereinafter, operation of the sheet feed section 14 and the sheet conveyance section 19 in duplex printing will be described.

Figure 2A:
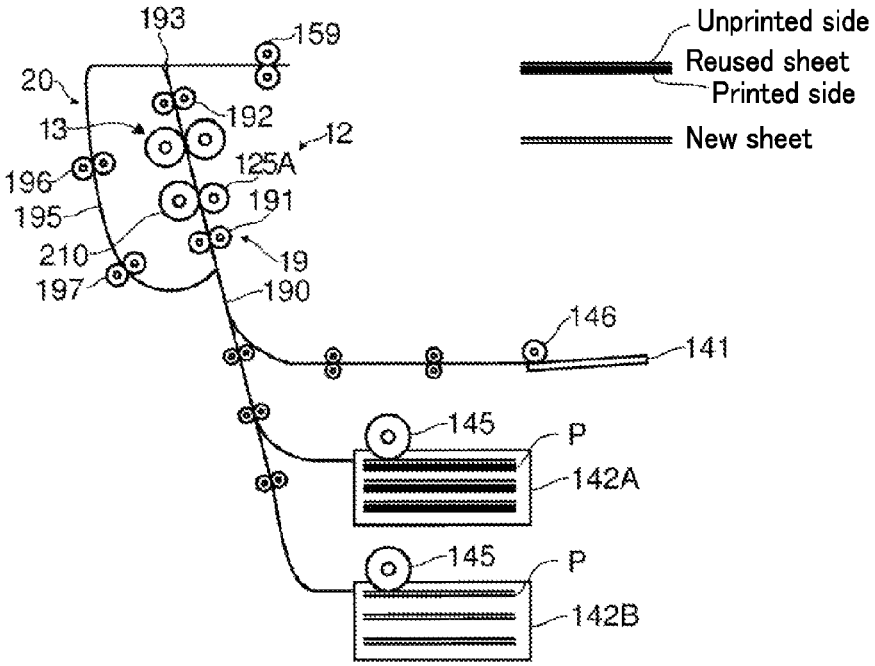
FIG. 2A is a diagram illustrating a structure of a sheet feed section and a sheet conveyance section of the image forming apparatus according to the embodiment of the present disclosure.
Figure 2B:
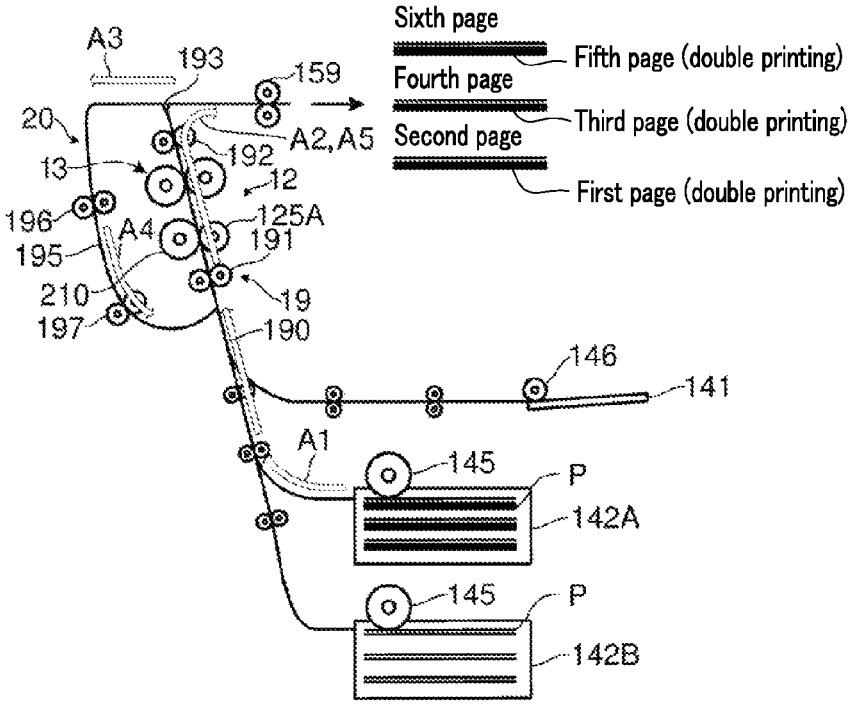
FIG. 2B is a diagram illustrating the movement of sheets in duplex printing.

FIG. 2A is a diagram illustrating the structure of the sheet feed section 14 and the sheet conveyance section 19. FIG. 2B is a diagram illustrating the movement of the sheet P in duplex printing. In the example illustrated in FIGS. 2A and 2B, reused sheets are stored in the sheet feed cassette 142A and new sheets are stored in the sheet feed cassette 142B. The following operation is performed in duplex printing in accordance with the control by an operation control section 101 of the control unit 10 (see FIG. 3) to be described later. The sheet feed roller 145 picks up and conveys toward the conveyance path 190 sheets P stored in the sheet feed cassette 142A indicated by an image formation instruction received by the reception section 103 (an arrow A1 in FIG. 2B). Subsequently, the image forming section 12 forms images on respective first sides of the sheets P based on image data of an even number page group among image data indicated by the image formation instruction received by the reception section 103. After a fixing process has been performed, the sheets P each become sandwiched in a nip between the pair of ejection rollers 159 located next to the exit tray 151 (an arrow A2 in FIG. 2B). The sheet conveyance section 19 includes a sheet reversing mechanism 20 for reversing sides (front and rear sides) of a sheet. The pair of ejection rollers 159 is a part of the sheet reversing mechanism 20 and causes switching back of the sheets P (an arrow A3 in FIG. 2B). A conveyance diverging guide 193 is provided in the conveyance path 190. Once the sheets P have each been switched back by the pair of ejection rollers 159, the sheets P are fed into a reverse conveyance path 195 by the conveyance diverging guide 193 (an arrow A4 in FIG. 2B). The reverse conveyance path 195 is a section of the conveyance path 190 that diverges from the ejection conveyance path 194. The sheets P are conveyed back to a position upstream of the nip N and the fixing section 13 in terms of the sheet conveyance direction by pairs of conveyance rollers 196 and 197 that are located along the reverse conveyance path 195, and the image forming section 12 forms images on respective second sides of the sheets P based on image data of an odd number page group (an arrow A5 in FIG. 2B). The sheets P are subsequently ejected onto the exit tray 151 by the pair of ejection rollers 159.

The sheet feed cassette 142B in which new sheets are stored should be selected in duplex printing. In the example illustrated in FIG. 2B, however, the sheet feed cassette 142A in which reused sheets are stored is mistakenly selected. As a result, the images based on the image data of the odd number page group (first, third, and fifth pages) are formed over the printed sides of the reused sheets.

Figure 3:
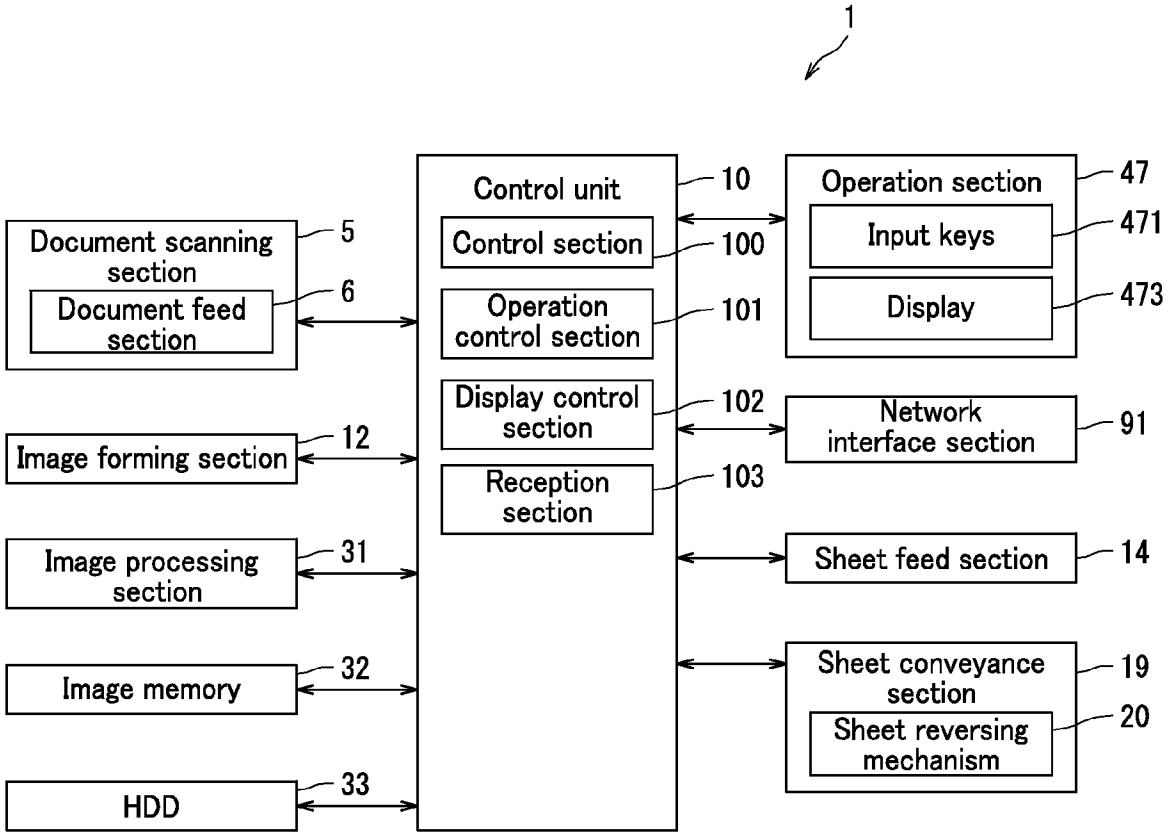
FIG. 3 is a block diagram illustrating configuration of main elements of the image forming apparatus according to the embodiment of the present disclosure.

Next, main elements of the image forming apparatus 1 will be described. FIG. 3 is a block diagram illustrating configuration of the main elements of the image forming apparatus 1.

The operation section 47 includes a plurality of input keys 471 and a display 473, and receives input from a user pertaining to various operations and processes that can be performed by the image forming apparatus 1. The display 473 includes a liquid crystal display or an organic electroluminescence display and displays various screen images such as a menu screen image indicated by a later-described display control section 102 of the control unit 10.

The input keys 471 includes for example a menu key, arrow keys, an enter key, character input keys, and number keys. The input keys 471 are operated by a user in response to a menu displayed by the display 473. The menu key is a key for calling up a menu. The arrow keys are keys for moving the focus of a GUI that forms the menu. The enter key is a key for confirming an operation with respect to the GUI forming the menu. The character input keys are keys for inputting characters. The number keys are keys for inputting numbers.

An image processing section 31 performs image processing as needed on image data of an image scanned by the document scanning section 5. The image processing section 31 for example performs predetermined image processing such as shading correction in order to improve image quality when the image forming section 12 performs image formation with respect to the image scanned by the document scanning section 5.

An image memory 32 temporarily stores therein image data that is generated through scanning by the document scanning section 5 and also temporarily stores therein data that is a printing target for the image forming section 12.

A hard disk drive (HDD) 33 is used to store for example image data that is output from the document scanning section 5.

A network interface section 91 includes a communication module such as a LAN board. The network interface section 91 performs transmission and reception of various types of data with a computer or the like via a LAN that is connected to the network interface section 91.

The control unit 10 includes a central processing unit (CPU), random access memory (RAM), and read only memory (ROM). The control unit 10 implements functions of the control section 100, the operation control section 101, the display control section 102, and the reception section 103 through execution by the CPU of a control program such as a duplex printing control program stored in the ROM or the HDD 33. The control section 100, the operation control section 101, the display control section 102, and the reception section 103 may each be implemented by hardware circuitry.

The control section 100 controls overall operation of the image forming apparatus 1.

The operation control section 101 controls operation of the image forming section 12, the sheet feed section 14, the sheet conveyance section 19, and so on in order to form images on sheets P based on image data indicated by an image formation instruction (job) received by the reception section 103. Detailed explanation of a process that is performed by the operation control section 101 is provided further below.

The display control section 102 controls the display 473.

The reception section 103 receives input from a user pertaining to image formation through the operation section 47.

Figure 4:
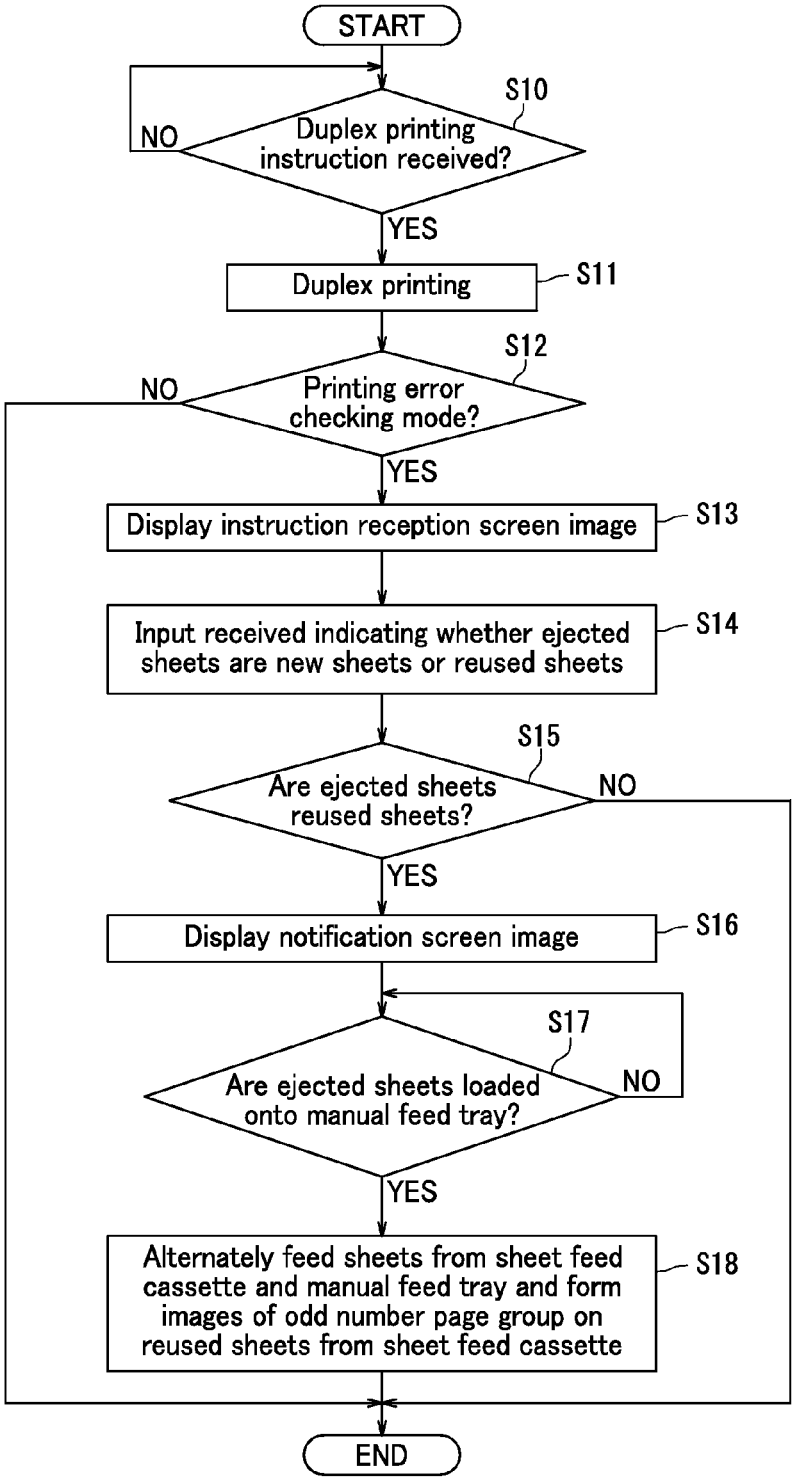
FIG. 4 is a flowchart illustrating operation of the image forming apparatus according to the embodiment of the present disclosure.
Figure 5:
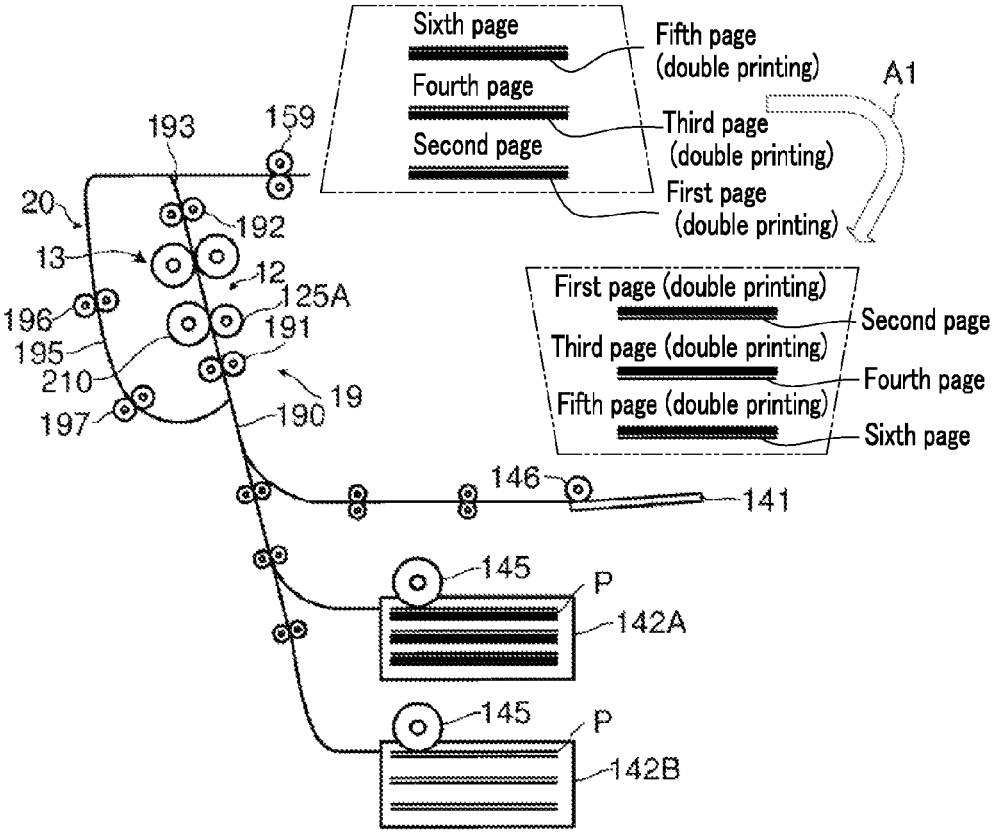
FIG. 5 is a diagram illustrating the movement of sheets in a printing error checking mode of the image forming apparatus according to the embodiment of the present disclosure.
Figure 6:
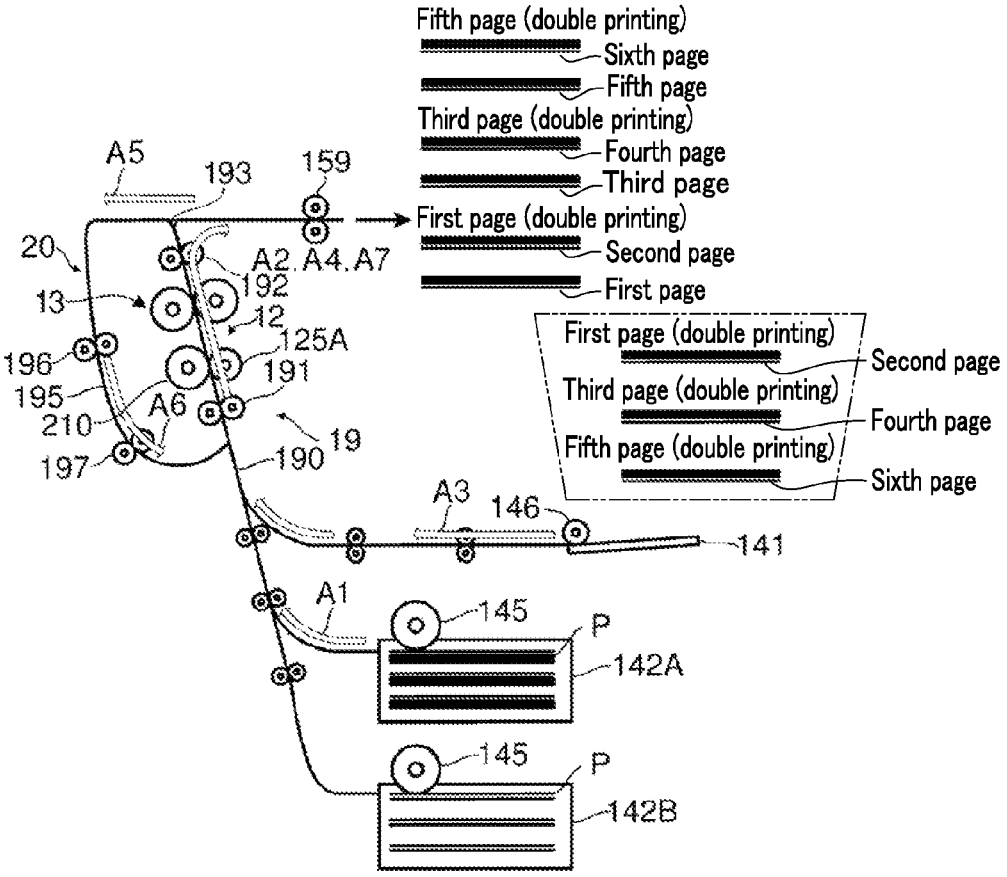
FIG. 6 is a diagram illustrating the movement of sheets in the printing error checking mode of the image forming apparatus according to the embodiment of the present disclosure.

Next, operation of the image forming apparatus 1 will be described. FIG. 4 is a flowchart illustrating operation of the image forming apparatus 1. FIGS. 5 and 6 are diagrams illustrating the movement of sheets P in the printing error checking mode.

The reception section 103 determines whether or not an instruction that instructs printing of images on both sides of sheets P (a duplex printing instruction) is received (Step S10).

When a duplex printing instruction is received (Yes in Step S10), the operation control section 101 controls operation of the image forming section 12, the sheet feed section 14, the sheet conveyance section 19, and so on in order to execute a duplex printing process (Step 11). More specifically, the operation control section 101 controls the sheet feed section 14 to feed one or more sheets P stored in a specific one of the sheet feed cassettes 142 that is indicated by the duplex printing instruction received by the reception section 103 as illustrated in FIG. 2B. The operation control section 101 then controls the image forming section 12 to form images on both sides of the sheets P fed from the sheet feed section 14 based on image data included in the duplex printing instruction.

Figure 7:
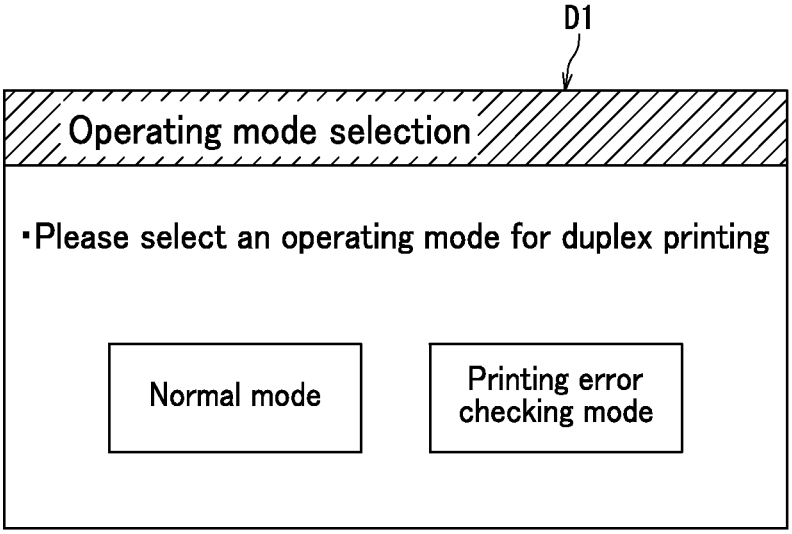
FIG. 7 is a diagram illustrating a selection screen image displayed by a display of the image forming apparatus according to the embodiment of the present disclosure.

After the duplex printing process has been performed, the operation control section 101 determines whether an operating mode for duplex printing is the normal mode or the printing error checking mode (Step S12). The operating mode for duplex printing is set in advance based on an instruction from the user that is input through the operation section 47. The display 473 for example displays a selection screen image D1 illustrated in FIG. 7 in accordance with control by the display control section 102. The reception section 103 receives a setting for the operating mode for duplex printing based on an instruction that is input through the selection screen image D1.

When the current operating mode for duplex printing is the normal mode (No in Step S12), the operation control section 101 ends the process.

Figure 8A:
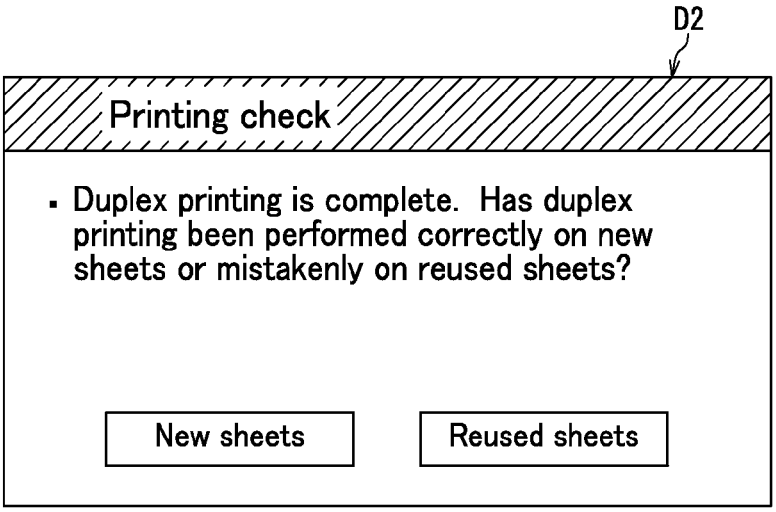
FIG. 8A is a diagram illustrating an instruction reception screen image displayed by the display of the image forming apparatus according to the embodiment of the present disclosure.

When the operating mode for duplex printing is the printing error checking mode (Yes in Step S12), the display control section 102 controls the display 473 to display an instruction reception screen image D2 (see FIG. 8A) (Step S13). The instruction reception screen image D2 is displayed for receiving input indicating whether the sheets P ejected onto the exit tray 151 are new sheets that have undergone image formation or reused sheets that have undergone image formation.

After the instruction reception screen image D2 has been displayed, the reception section 103 receives input from the user that indicates whether the sheets P ejected onto the exit tray 151 are new sheets that have undergone image formation (Step S14).

When the input received in Step S14 indicates that the sheets P ejected onto the exit tray 151 are new sheets that have undergone image formation (No in Step S15), the operation control section 101 ends the process in the printing error checking mode.

Figure 8B:
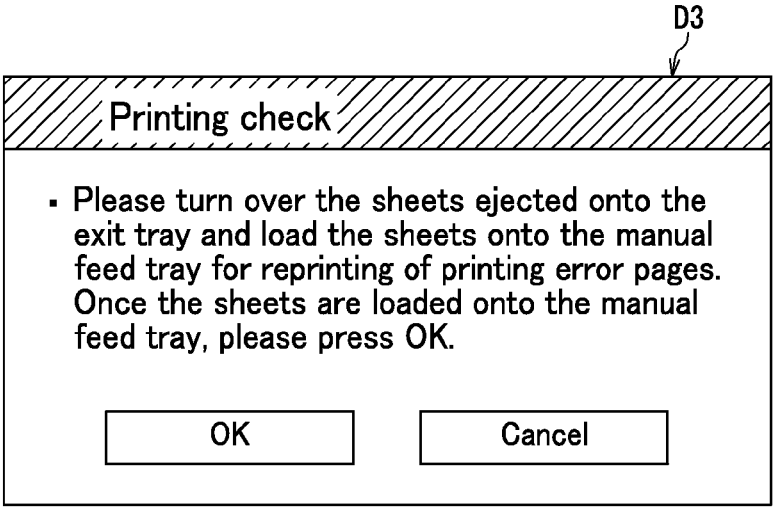
FIG. 8B is a diagram illustrating a notification screen image.

On the other hand, when the input received in Step S14 indicates that the sheets P ejected onto the exit tray 151 are reused sheets that have undergone image formation (Yes in Step S15), the display control section 102 controls the display 473 to display a notification screen image D3 (see FIG. 8B)

(Step S16). The notification screen image D3 is a screen image that prompts the user to turn over the sheets that have been ejected onto the exit tray 151 and to load the turned-over sheets onto the manual feed tray 141. In accordance with the notification on the notification screen image D3, the user moves the sheets P ejected onto the exit tray 151. The sheets P are moved as indicated by an arrow A1 in FIG. 5.

Once the notification screen image D3 is displayed, the operation control section 101 determines whether or not the sheets P ejected onto the exit tray 151 have been loaded onto the manual feed tray 141 (Step S17). More specifically, text is displayed in the notification screen image D3 that prompts pressing of an "OK" button once the sheets P have been loaded onto the manual feed tray 141. The operation control section 101 determines that the sheets P ejected onto the exit tray 151 have been loaded onto the manual feed tray 141 when the user touches the "OK" button. Alternatively, the operation control section 101 may determine that the sheets P have been loaded onto the manual feed tray 141 using a sensor that senses presence or absence of sheets P that have been loaded onto the manual feed tray 141, for example. More specifically, the sensor that detects presence or absence of sheets P loaded onto the manual feed tray 141 is provided above the manual feed tray 141. The operation control section 101 refers to a signal output from the sensor to determine that the sheets P ejected onto the exit tray 151 have been loaded onto the manual feed tray 141.

When determining that the sheets P ejected onto the exit tray 151 have been loaded onto the manual feed tray 141 (Yes in Step S17), the operation control section 101 controls the sheet feed section 14 to alternately feed sheets P stored in the sheet feed cassette 142A and the sheets P loaded onto the manual feed tray 141. The operation control section 101 then controls the image forming section 12 to form images on the sheets P fed from the sheet feed cassette 142A (Step S18).

More specifically, the operation control section 101 controls the image forming section 12 to form images based on image data of an odd number page group at times at which sheets P stored in the sheet feed cassette 142A are fed by the sheet feed section 14. The operation control section 101 then controls the sheet conveyance section 19 to eject onto the exit tray 151 the sheets P on which the images have been formed by the image forming section 12. At times at which sheets P loaded onto the manual feed tray 141 are fed by the sheet feed section 14, the operation control section 101 controls the image forming section 12 to not form any additional image on the sheets P. The operation control section 101 then controls the sheet conveyance section 19 to reverse the sides of each of the sheets P on which no additional image has been formed by the image forming section 12 and subsequently to eject the sheets P onto the exit tray 151.

In the example illustrated in FIG. 6, a sheet P stored in the sheet feed cassette 142A is fed by the sheet feed roller 145 (an arrow A1 in FIG. 6), and an image based on image data of an odd number page (first page) is formed by the image forming section 12 on an unprinted side of the sheet P (an arrow A2 in FIG. 6). Next, the sheet P is ejected onto the exit tray 151 such that the side thereof on which the image (first page) has been formed is facing downward (so called "face-down ejection").

The sheets P ejected onto the exit tray 151 are loaded onto the manual feed tray 141 after being turned over. Accordingly, the sheets P are loaded onto the manual feed tray 141 such that the sides thereof on which the images have been appropriately formed are facing downward. The sheet P on which an image based on image data of the second page has been formed on the unprinted side thereof and which have been loaded onto the manual feed tray 141 is fed by the sheet feed roller 146 right after the sheet P on which the image based on the image data of the first page has been formed is ejected onto the exit tray 151 (an arrow A3 in FIG. 6). The image forming section 12 forms no additional image on the sheet P on which the image based on the image data of the second page has been formed (an arrow A4 in FIG. 6). Next, the sheet P is switched back by the pair of ejection rollers 159 (an arrow A5 in FIG. 6), and subsequently conveyed to the reverse conveyance path 195 (an arrow A6 in FIG. 6) so that the sides of the sheet P is reversed. The sheet P is conveyed back to a position upstream of the nip N and the fixing section 13 in terms of the sheet conveyance direction and ejected onto the exit tray 151 by the pair of ejection rollers 159 with no additional image formed thereon by the image forming section 12 (an arrow A7 in FIG. 6). Thus, the sheet P is ejected onto the exit tray 151 such that the side thereof on which the image (second page) has been appropriately formed is facing downward. Through repetition of the above-described process, the sheets P can be ejected onto the exit tray 151 such that the sides thereof on which the images have been appropriately formed are facing downward and such that the images formed thereon are arranged in page order.

Supplementary Explanation

So far, the configuration has been described as the embodiment in which sheets P are ejected onto the exit tray 151 such that sides thereof on which images have been formed by the image forming section 12 are facing downward. Hereinafter, the configuration will be described in which sheets P are ejected onto the exit tray 151 such that sides thereof on which images have been formed by the image forming section 12 are facing upward (so called "face-up ejection").

Figure 9:
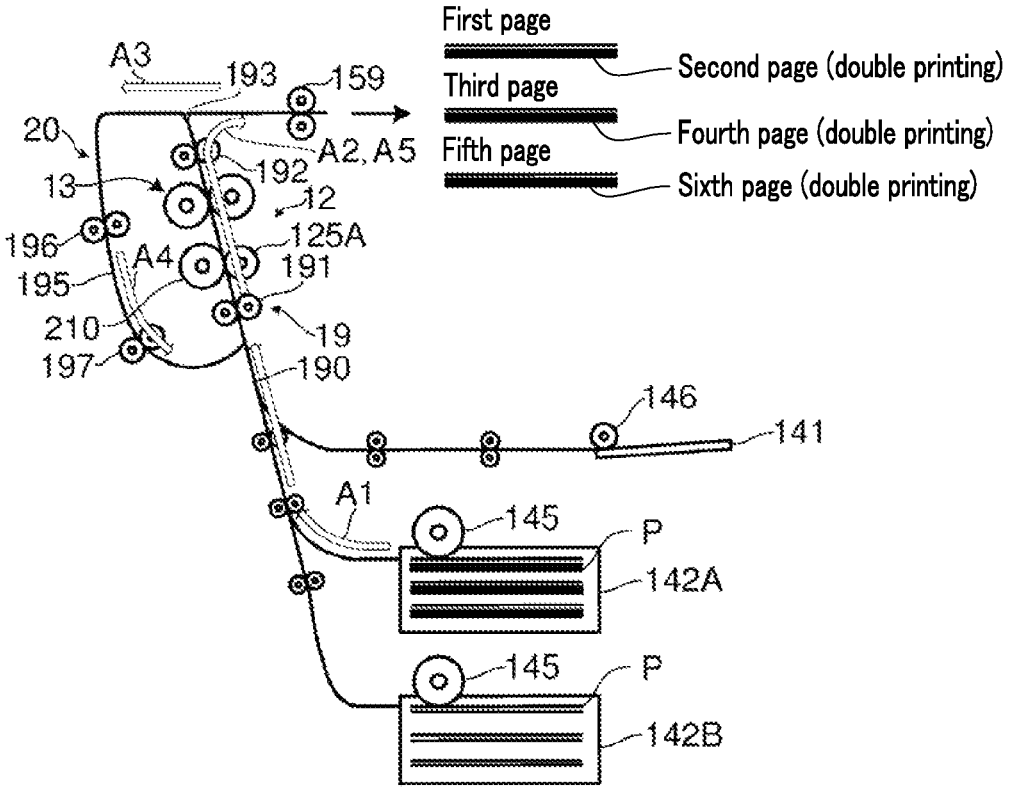
FIG. 9 is a diagram illustrating the movement of sheets in duplex printing in a configuration in which the sheets are ejected onto an exit tray such that sides thereof on which images have been formed are facing upward.

FIG. 9 is a diagram illustrating the movement of sheets P in duplex printing in a configuration in which the sheets P are ejected onto the exit tray 151 such that sides thereof on which images have been formed are facing upward. In duplex printing, the sheet feed roller 145 picks up and conveys toward the conveyance path 190 sheets P stored in the sheet feed cassette 142A indicated by an image formation instruction received by the reception section 103 (an arrow A1 in FIG. 9). Subsequently, the image forming section 12 forms images on respective first sides of the sheets P based on image data of an odd number page group among image data indicated by the image formation instruction received by the reception section 103. After a fixing process has been performed, the sheets P each become sandwiched in the nip between the pair of ejection rollers 159 located next to the exit tray 151 (an arrow A2 in FIG. 9). Thereafter, the pair of ejection rollers 159 causes switching back of the sheets P (an arrow A3 in FIG. 9). Once the sheets P have each been switched back by the pair of ejection rollers 159, the sheets P are fed from the ejection conveyance path 194 into the reverse conveyance path 195 by the conveyance diverging guide 193 (an arrow A4 in FIG. 9). The sheets P are conveyed back to the position upstream of the nip N and the fixing section 13 in terms of the sheet conveyance direction by the pairs of conveyance rollers 196 and 197 that are located along the reverse conveyance path 195, and the image forming section 12 forms images of an even number page group on respective second sides of the sheet P (an arrow A5 in FIG. 9). The sheets P are subsequently ejected onto the exit tray 151 by the pair of ejection rollers 159. As a result, the images based on the image data of the even number page group (second, fourth, and sixth pages) are formed over the printed sides of the reused sheets.

As described above, in the configuration in which sheets P are ejected onto the exit tray 151 such that sides thereof on which images have been formed are facing upward, images based on image data of an even number page group are formed over printed sides of reused sheets. As illustrated in FIG. 2B, in the configuration in which sheets P are ejected onto the exit tray 151 such that sides thereof on which images have been formed are facing downward, images based on image data of an odd number page group are formed over printed sides of reused sheets.

After the sheets P that have been ejected onto the exit tray 151 such that sides thereof on which images have been formed are facing upward are loaded onto the manual feed tray 141, therefore, the operation control section 101 controls the image forming section 12 to form, on sheets P fed by the sheet feed section 14 from the sheet feed cassette 142A, the images that have been formed over the printed sides of the sheets P based on the image data of the even number page group in the duplex printing.

As described above, in the image forming apparatus 1 according to the embodiment of the present disclosure, the operation control section 101 performs the following process when sheets P ejected onto the exit tray 151 are loaded onto the manual feed tray 141 after duplex printing is performed. First, the operation control section 101 controls the sheet feed section 14 to alternately feed sheets P stored in the sheet feed cassette 142A and the sheets P loaded onto the manual feed tray 141. Then, at times at which sheets P stored in the sheet feed cassette 142A are fed by the sheet feed section 14, the operation control section 101 controls the image forming section 12 to form, on sheets P fed from the sheet feed cassette 142A, images that have been formed over the printed sides of the sheets P in the duplex printing. The operation control section 101 subsequently controls the sheet conveyance section 19 to eject onto the exit tray 151 the sheets P on which the images have been formed by the image forming section 12. At times at which the sheets P loaded onto the manual feed tray 141 are fed by the sheet feed section 14, the operation control section 101 controls the image forming section 12 to not form any additional image on the sheets P. The operation control section 101 then controls the sheet conveyance section 19 to eject onto the exit tray 151 the sheets P on which no additional image has been formed by the image forming section 12.

The above-described configuration allows minimization of wasted sheets P even when the sheet feed cassette 142A storing reused sheets is mistakenly selected for duplex printing, because in case of a printing error where printing is performed over printed sides of reused sheets, only image data relevant to the printing error is used to perform reprinting. Furthermore, the sheets P that have undergone the reprinting based only on the image data relevant to the printing error are ejected onto the exit tray 151 such that they are inserted into appropriate positions among the sheets P that have undergone the previous printing. The configuration thus saves the need for a user to create a job of printing that is based only on image data relevant to the printing error and to insert the sheets that have undergone the reprinting into the sheets that have undergone the previous printing, providing improved user convenience.

In the image forming apparatus 1 according to the embodiment of the present disclosure, the sheet conveyance section 19 ejects sheets P onto the exit tray 151 such that sides of the sheets P on which images have been formed are facing downward. In this configuration, the operation control section 101 controls the image forming section 12 to form images on sheets P fed from the sheet feed cassette 142A based on image data of an odd number page group among image data indicated by an instruction for image formation on a plurality of sheets P received by the reception section 103. The images based on the image data of the odd number page group are images that have been formed over printed sides of the sheets P in duplex printing on the sheets P.

The above-described configuration in which sheets P are ejected onto the exit tray 151 such that sides thereof on which images have been formed are facing downward allows reprinting based only on image data that have been used in the printing over the printed sides.

Alternatively, in the image forming apparatus 1 according to the embodiment of the present disclosure, the sheet conveyance section 19 ejects sheets P onto the exit tray 151 such that sides of the sheets P on which images have been formed are facing upward. In this configuration, the operation control section 101 controls the image forming section 12 to form images on sheets P fed from the sheet feed cassette 142A based on image data of an even number page group among image data indicated by an instruction for image formation on a plurality of sheets P received by the reception section 103. The images based on the image data of the even number page group are images that have been formed over printed sides of the sheets P in duplex printing on the sheets P.

The above-described configuration in which sheets P are ejected onto the exit tray 151 such that sides thereof on which images have been formed are facing upward allows reprinting based only on image data that have been used in the printing over the printed sides.

In the image forming apparatus 1 according to the embodiment of the present disclosure, the operation control section 101 controls the sheet conveyance section 19 to first reverse the sides of each of the sheets P fed from the manual feed tray 141 and then eject the sheets P onto the exit tray 151 at times at which the sheets P loaded onto the manual feed tray 141 are fed by the sheet feed section 14.

The above-described configuration allows the sheets P that have been ejected onto the exit tray 151, turned over, and then loaded onto the manual feed tray 141 to be ejected onto the exit tray 151 such that the sides thereof on which the images have been appropriately formed are facing downward (so called "face-down ejection") and such that the images formed thereon are arranged in page order.

It should be noted that the present disclosure is not limited to the configuration in the above embodiment and various alternations may be made. For example, the image forming apparatus according to the present disclosure is described in the above embodiment using a multifunction peripheral, but the multifunction peripheral is just one example of the image forming apparatus and the image forming apparatus may for example alternatively be a printer, a copier, or a facsimile machine.

The configuration is described in the above embodiment in which the reception section 103 receives, after a duplex printing process, input from a user indicating whether the sheets P ejected onto the exit tray 151 are new sheets that have undergone image formation or reused sheets that have undergone image formation. However, the present disclosure is not limited to the configuration.

After a duplex printing process, the operation control section 101 may store in the HDD 33 image data used for the image formation in the duplex printing. Thereafter, once the sheets P are loaded onto the manual feed tray 141 and the reception section 103 receives selection of the printing error checking mode, the operation control section 101 may perform the following process. First, the operation control section 101 controls the sheet feed section 14 to alternately feed sheets P stored in the sheet feed cassette 142A and the sheets P loaded onto the manual feed tray 141. Then, the operation control section 101 controls the image forming section 12 to form images on the sheets P fed from the sheet feed cassette 142A based on the image data stored in the HDD 33.

The configurations and processes explained in the above embodiment with reference to FIGS. 1 to 9 are merely an example of implementation of the present disclosure, and the present disclosure is not limited to the aforementioned configurations and processes.

What is claimed is:

1. An image forming apparatus comprising:

a sheet feed section that includes a sheet feed cassette and a manual feed tray and that is configured to feed a sheet stored in the sheet feed cassette or a sheet loaded onto the manual feed tray;

a sheet conveyance section that includes a sheet reversing mechanism for reversing sides of the sheet and that is configured to convey the sheet fed by the sheet feed section;

a reception section configured to receive input pertaining to image formation;

an image forming section configured to form an image on the sheet based on image data indicated by an image formation instruction received by the reception section;

an exit tray onto which the sheet is ejected after the image has been formed thereon by the image forming section; and an operation control section configured to control operation of the sheet feed section, the sheet conveyance section, and the image forming section, wherein the operation control section controls the sheet conveyance section to reverse the sheet using the sheet reversing mechanism in order to perform duplex image formation on the sheet, and when duplex image formation is performed on one or more reused sheets each having a printed side and an unprinted side fed from the sheet feed cassette and the reused sheets on which the duplex image formation has been performed are loaded onto the manual feed tray, the operation control section:

controls the sheet feed section to alternately feed sheets stored in the sheet feed cassette and the sheets loaded onto the manual feed tray;

controls the image forming section to form, on the sheets fed from the sheet feed cassette, images that have been formed over the respective printed sides of the reused sheets in the duplex image formation at times at which the sheets stored in the sheet feed cassette are fed by the sheet feed section;

controls the sheet conveyance section to eject onto the exit tray the sheets which have been fed from the sheet feed cassette and on which the images have been formed;

controls the image forming section to not form an image at times at which the sheets loaded onto the manual feed tray are fed by the sheet feed section; and controls the sheet conveyance section to eject onto the exit tray the sheets that have been fed from the manual feed tray.

2. The image forming apparatus according to claim 1, wherein the sheet conveyance section is configured to eject onto the exit tray the sheet on which the image is formed such that a side of the sheet on which the image has been formed is facing downward, and the operation control section controls the image forming section to form, as the images that have been formed over the respective printed sides of the reused sheets in the duplex image formation, images on the sheets fed from the sheet feed cassette based on image data of an odd number page group among image data indicated by an image formation instruction received by the reception section in the duplex image formation performed on the reused sheets.

3. The image forming apparatus according to claim 1, wherein the sheet conveyance section is configured to eject onto the exit tray the sheet on which the image is formed such that a side of the sheet on which the image has been formed is facing upward, and the operation control section controls the image forming section to form, as the images that have been formed over the respective printed sides of the reused sheets in the duplex image formation, images on the sheets fed from the sheet feed cassette based on image data of an even number page group among image data indicated by an image formation instruction received by the reception section in the duplex image formation performed on the reused sheets.

4. The image forming apparatus according to claim 2, wherein at times at which the sheets loaded onto the manual feed tray are fed by the sheet feed section, the operation control section controls the sheet conveyance section to first reverse the sides of each of the sheets using the sheet reversing mechanism and then eject the sheets onto the exit tray.

5. The image forming apparatus according to claim 1, wherein when the reception section receives an instruction for duplex image formation on one or more sheets, the operation control section:

controls the sheet feed section to feed sheets stored in the sheet feed cassette indicated by the instruction received by the reception section;

controls the image forming section to perform the duplex image formation on the sheets fed by the sheet feed section; and controls the sheet conveyance section to eject the sheets onto the exit tray after the duplex image formation has been performed by the image forming section, the reception section receives, after the duplex image formation has been performed and the sheets have been ejected onto the exit tray by the sheet conveyance section, input from a user indicating whether the sheets ejected onto the exit tray are new sheets that have undergone the duplex image formation or reused sheets that have undergone the duplex image formation, and when the sheets ejected onto the exit tray have been loaded onto the manual feed tray and the reception section receives input from the user indicating that the sheets ejected onto the exit tray are reused sheets that have undergone the duplex image formation, the operation control section controls the sheet feed section to alternately feed sheets stored in the sheet feed cassette and the sheets loaded onto the manual feed tray.

6. The image forming apparatus according to claim 5, further comprising a display and a display control section that controls display operation by the display, wherein after the duplex image formation has been performed on the sheets and the sheets have been ejected onto the exit tray by the sheet conveyance section, the display control section controls the display to display an instruction reception screen image through which the reception section receives the input indicating whether the sheets ejected onto the exit tray are new sheets that have undergone the duplex image formation or reused sheets that have undergone the duplex image formation.

7. The image forming apparatus according to claim 6, wherein the display control section controls the display to display a notification screen image that prompts the user to load onto the manual feed tray the sheets that have been ejected onto the exit tray.

8. The image forming apparatus according to claim 1, wherein the sheet feed section includes a plurality of sheet feed cassettes, and at least one of the plurality of sheet feed cassettes stores reused sheets therein.

9. The image forming apparatus according to claim 8, wherein the sheet feed cassette from which the sheets are fed is set from among the plurality of sheet feed cassettes based on the image formation instruction received by the reception section.

* * * * *